United States Patent [19]

Cribb, Jr. et al.

[11] Patent Number: 4,545,508

[45] Date of Patent: Oct. 8, 1985

[54] PLASTIC CLOSURE FOR GRATED CHEESE OR THE LIKE

[75] Inventors: B. Jay Cribb, Jr., Waukegan, Ill.; Edward J. Drozd, Jr., Lake Hiawatha, N.J.; Ian R. Wilmot, Rowville, Australia; Debradell C. Leap, Palatine, Ill.

[73] Assignee: Kraft, Inc., Glenview, Ill.

[21] Appl. No.: 456,803

[22] Filed: Jan. 10, 1983

[51] Int. Cl.[4] ..... B65D 47/08

[52] U.S. Cl. ..... 222/153; 222/480; 222/482; 222/545; 222/556

[58] Field of Search ..... 222/480–482, 222/498, 545, 546, 556, 558, 485, 484, 487, 142.5, 153; 220/339, 307, 254

[56] References Cited

U.S. PATENT DOCUMENTS

| | | | |
|---|---|---|---|
| 2,777,615 | 1/1957 | De Shazor, Jr. | 222/480 |
| 3,155,285 | 11/1964 | Van Baarn | 222/546 X |
| 4,047,647 | 9/1977 | Lewis | 222/480 |
| 4,106,672 | 8/1978 | Tecco et al. | 222/546 X |
| 4,358,032 | 11/1982 | Libit | 222/556 X |
| 4,369,888 | 1/1983 | Walter | 220/307 X |

*Primary Examiner*—Charles A. Marmor

*Attorney, Agent, or Firm*—Fitch, Even, Tabin & Flannery

[57] ABSTRACT

A container lid such as a lid for a parmesan cheese container or the like, having a plurality of independently operative openings which is formed of a one piece two layer central bulk access and peripheral crescent-shaped broadcast construction, and which provides a substantially airtight seal for the container, which permits the container to be repeatedly and readily opened and closed, and which selectively permits bulk removal and access to the interior of the container, or the broadcast of the contents of the container through one or more limited access openings in the closure.

6 Claims, 8 Drawing Figures

Fig. 7.
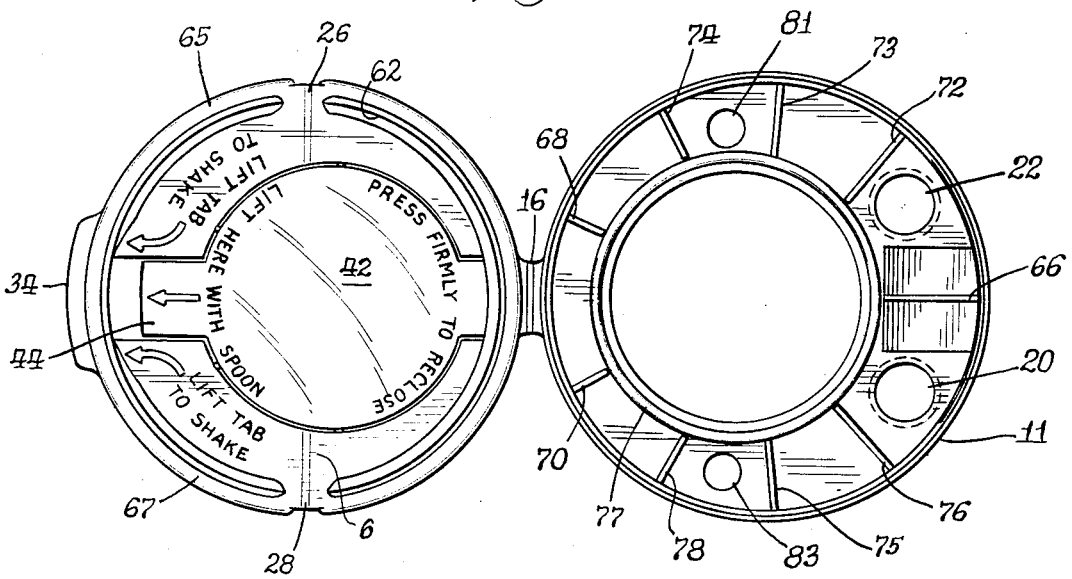
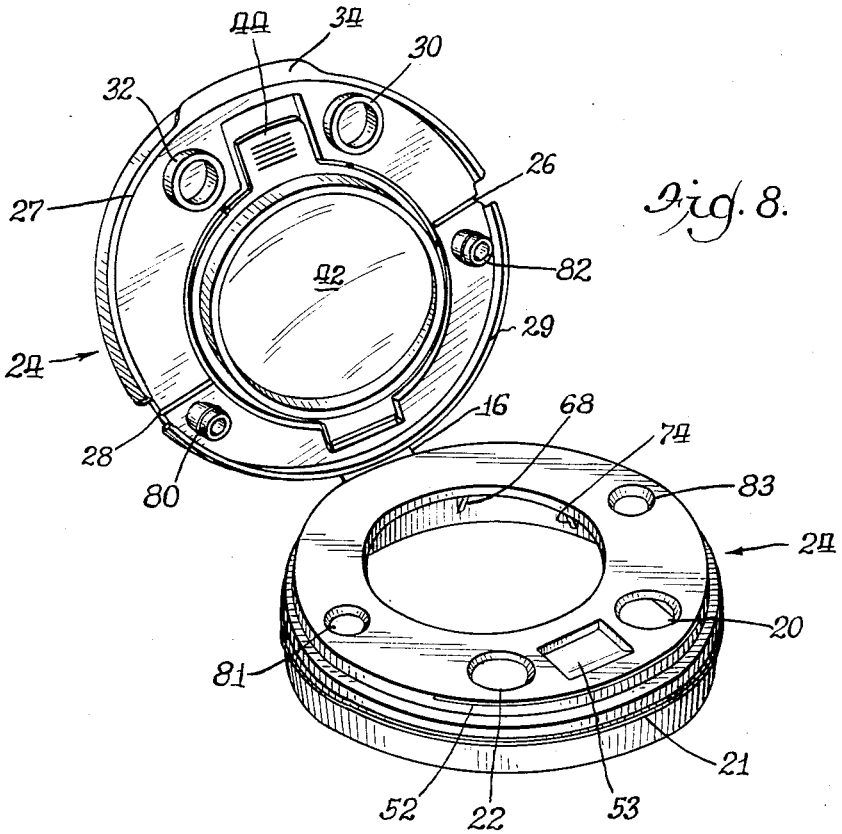
Fig. 8.

PLASTIC CLOSURE FOR GRATED CHEESE OR THE LIKE

The present invention relates to closures for containers. More particularly, the present invention relates to a dual action closure for containers for particulate foods including foods which are grated or otherwise comminuted, such as grated cheese, wherein the closure provides a generally air-tight seal prior to opening of the container, which for product protection, upon opening selectively provides either limited or bulk access to the particulate contents of the container, and which may readily be reclosed by the user.

Particulate comestibles such as grated cheeses, and the like are conventionally packaged in containers having closures made of metal and/or plastic discs which seal the container prior to opening and use of the contents for preservation of the contents of the container. One form of conventional closure has a bottom, initially imperforate metal closure element which forms a seal with the top rim of a cylindrical container and which seals the container prior to opening the container for use of the contents. However, a portion of the bottom metal closure element is scored to define a removable panel in the metal closure element, so that by applying appropriate force to the scored panel area, the panel may be displaced into the container to create an opening in the bottom closure element to open and unseal the container for use. A top member, which may be of plastic construction is rotatably mounted immediately adjacent the closure element and is conventionally provided with a plurality of openings which may be selectively aligned by the user to be in registration with the score-defined opening in the bottom closure element, and which slidably overlies the closure element to provide a closure which may be repeatedly and readily put into an open or closed position after the bottom element is opened and unsealed. The rotatable upper element which overlies the bottom member is held in slidable relation in respect to the bottom member such that after opening the sealed bottom member, the top member can be slidably positioned over the opening of the bottom member to permit the repeated opening or closing of the container. By rotation of the relative position of the top element in respect to the opening in the bottom element, various sized openings may be selected by the user, for example, for broadcast of relatively small, controlled amounts of the product directly from the container through one or more relatively small openings, or for dispensing of larger amounts through a larger opening.

Such closures have a number of disadvantages, however, particularly including difficulties in respect to controlled bulk removal of package contents such as by spooning of heaped tablespoon quantities of grated cheese or the like from the package. In this regard, conventional grated cheese containers such as disclosed in U.S. Pat. No. 2,961,132 having a top closure in which the openings in the top and bottom members are limited in size to accommodate the closing of the container by covering of the opening in the bottom member, thereby impeding ready access to the container interior by means of utensils such as measuring spoons and the like.

Accordingly, there is a need for a container for particulate comestibles such as grated cheese or the like including a closure assembly which provides a substantially airtight seal for the container, which permits the container to be repeatedly and readily opened and closed, which permits the contents to be broadcast through holes in the closure, the container serving as a shaker; which permits the bulk removal of the contents by providing easy access to the interior of the container and which permits the ready opening, unsealing, use and closure of the container.

Accordingly, it is an object of the present invention to provide a closure assembly for a grated cheese container or the like which can be repeatedly and readily opened or closed, and which selectively permits bulk removal and access to the interior of the container, or the broadcast of the contents of the container through one or more limited access openings in the closure.

These and other objects of the invention will become apparent with reference to the following detailed description and accompanying drawings of which:

FIG. 7 is a bottom view of the closure prior to assembly; and

FIG. 8 is a perspective view of the closure being assembled for seating onto a container.

Generally in accordance with the present invention, a multiaction closure is provided for a grated cheese container or the like, which may be readily and repeatedly opened to permit bulk removal or broadcast of the contents. In accordance with the present invention, a rigid one-piece organopolymeric closure for a container for particulate materials is provided which has a substantially planar two-layer composite top panel and a skirt for engagement with the proximate rim of an associated container. As indicated, the top panel is of composite, layered configuration, including a lower element and an upper overlying element, which includes a first means comprising a relatively large, substantially circular opening for bulk access to the container interior with a circular cover therefor which is hingedly connected to the top panel, and tongue-in-groove means for interlocking of the cover and the top panel in closed position. The top panel is also provided with a second means comprising at least one, relatively small circular opening positioned peripherally of the bulk access opening for broadcast or more limited removal of the container contents and a second cover therefor hingedly connected to the top panel of the closure, and tongue-in-groove means for interlocking of the cover and the top panel in closed position. Each cover is separately operable to be repeatedly and readily opened and closed to provide a frictional, sealing, continuous interference fit engagement with the respective openings of the top panel.

Figure 4:
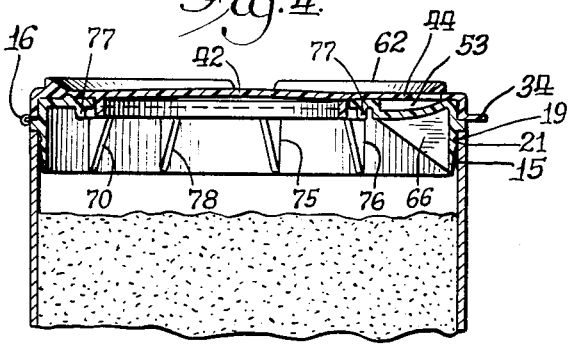
FIG. 4 is a side view of the closure of FIG. 1 taken along line 4—4 of FIG. 1.
Figure 5:
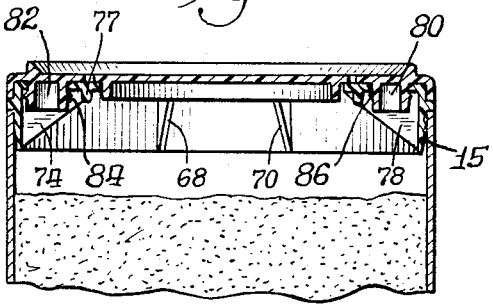
FIG. 5 is a front view of the closure of FIG. 1 taken along line 5—5 of FIG. 1.
Figure 6:
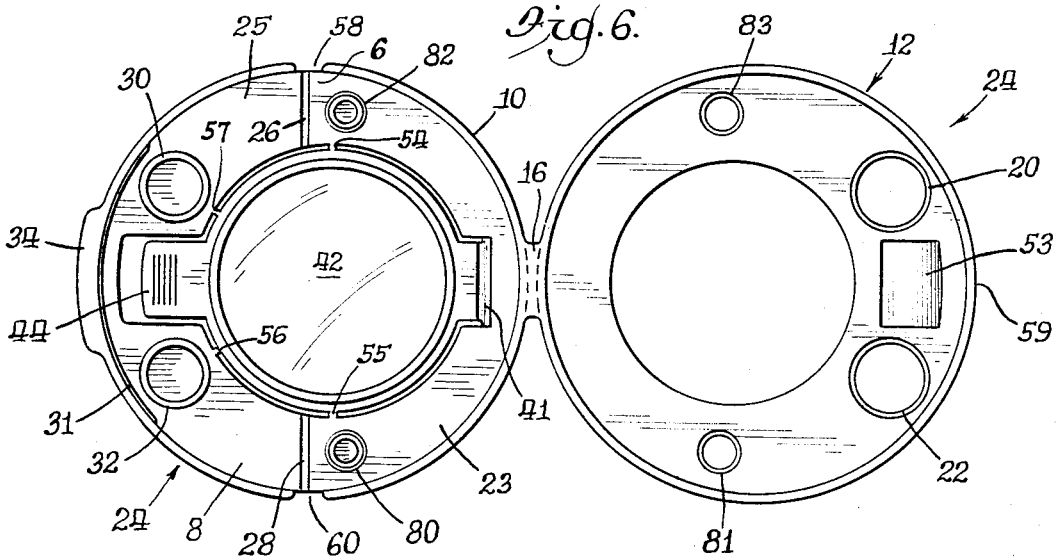
FIG. 6 is a top view of the closure prior to assembly.

Turning now to the drawings, the present invention will now be more particularly described with respect to the specific embodiment of a closure 4 and associated cylindrical container 2 illustrated therein. The illustrated closure 4 is made of an organopolymeric material such as polypropylene or the like having a flexural modulus of at least about 170,000 psi and preferably in the range of from about 170,000 to about 250,000 psi. The illustrated closure 4 is formed in one piece by injection molding, as will be described in more detail hereinafter, and comprises a top 6 and base 12 as shown in FIG. 6. The top 6 is connected to the base 12 by an integral hinge 16 as shown in FIG. 6, which illustrates the closure in unassembled form. The illustrated top 6 has a round planar body 8 with a depending lip 10, annularly surrounding the round planar body at its periphery, for engagement with the internal rim of the associated container 2, and is further provided with a circular planar top support 14 with a depending skirt 15 annularly surrounding it at its periphery, as seen in FIGS. 4 and 5. When associated with a container, the depending skirt 15 projects into the inside surface of the side walls of the container with two peripheral rings 19, 21 which project from the outer surface of the depending skirt 15, and which are adhesively affixed to the interior container rim by means of a suitable adhesive, which in the illustrated embodiment is appropriately applied to the interior of the container. Above the peripheral rings 19, 21, annular sealing rim 11 project radially from the outer surface of depending skirt 15, such that the lower surface of the sealing rim may abut and set upon the upper surface of an associated container when the closure is sealed onto the container. A suitable adhesive may be used to seal the closure 4 to the container 2, which may be applied across the container top to provide an air-tight seal between the container 2 and the multiaction closure 4. The closure 4 itself provides a functional seal for the entire container assembly. Immediately below the peripheral rings 19, 21, the lower portion of the depending skirt 15 is beveled radially inwardly about 15° from the horizontal to facilitate centering and sealing the closure 4 to the associated container 2.

Figure 3:
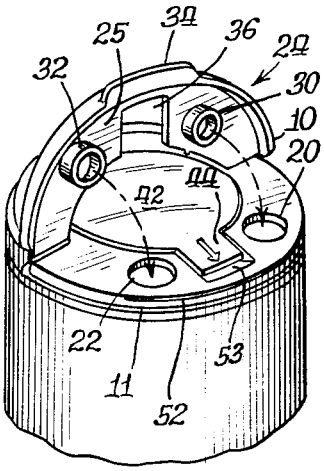
FIG. 3 is a perspective view of the closure and container wherein the closure is opened exposing holes to permit the broadcast of the contents of the container with the container serving as a shaker device for such broadcast.

The illustrated multiaction closure 4 provides two independently operative means for providing access into the associated container. An annular means for access 18, as shown in FIG. 3, comprises a lid 24 which is annular or peripheral to the center of the closure, which is a part of top 6, and overlies an annular sector 25 of the planar top support 14 of the closure. Holes 20 and 22 in the annular sector 25 provide a means through which the contents of the container may flow upon use. The annular lid 24 forms the front portion of top 6 and is connected to the rear portion 23 of the top by integral hinges 26 and 28, which are integrally molded in the structure of the one piece closure 4. Depending lip 10 extends downwardly in a direction substantially orthogonal to the planar body 8 and thereby provides a depending skirt 27 for the periphery of the annular lid 24. Notches 58 and 60 in the depending lip 10 separate the depending skirt 27 of the annular lid 24 from the depending skirt 29 of the rear portion 23 of top 6 to facilitate the opening and closing of lid 24 at hinges 26 and 28. The organopolymeric material forming the closure is relatively thin at these hinges as shown at 33 to readily permit the annular lid to be reciprocated over holes 22 and 20. A tab 34 orthogonally extends from the outer surface of the depending skirt 27 of annular lid 24 to provide a gripping surface to repeatedly and readily open and close the lid, which when closed is held by frictional, interlocking engagement over annular sector 25, as will be further described. Cylindrical posts 30 and 32 orthogonally depend from the lower surface of lid 24 opposite holes 20 and 22 such that when the lid is closed, cylindrical posts 30 and 32 will extend into and engage holes 22 and 20 respectively. the external surfaces of posts 30 and 32 gently incline to a beveled crest which frictionally engages the side walls of holes 20 and 22 to provide a functional seal when the lid 24 is in closed position. Opposite tab 34 on the internal surface of depending skirt 27, an annular lid projection 31 is provided for tongue-in-groove fitment with a mating recess which projects inwardly and substantially orthogonal to depending skirt 27. A projection 52 extends substantially orthogonally from the top front portion of depending skirt 15 of base 12, which frictionally co-acts upon closure in a tongue-in-groove fitment with lid projection 31 when the lid 24 is closed, and maintains the circular beveled posts 30, 32 in compressed relationship into and against the respective openings 20, 22 of the bottom element 12. The front of annular sector 25 of lid 24 has a rectangular notch 36 to facilitate the repeated opening and closing the second means for access as will be further described. The lid 24 provides a snap-fit engagement upon closure, which provides the consumer with a tactile signal that the lid is in the closed position.

Figure 2:
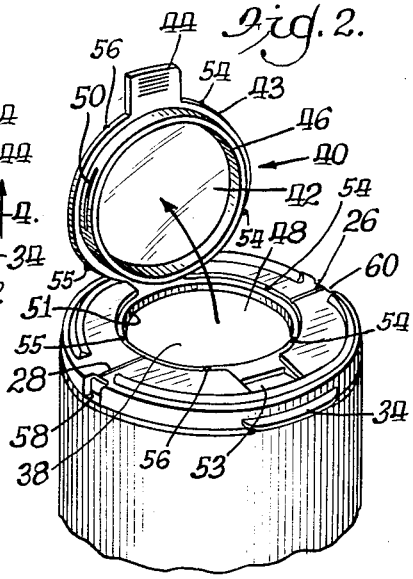
FIG. 2 is a perspective view of the closure and container wherein the closure is opened to permit access to the interior of the container and bulk removal of the contents.

The second means for access 38, as shown in FIG. 2, includes second lid 40, which is part of top 6, and circular bulk access aperture in base 12. The second lid and bulk access aperture are generally round and are located in a centrally offset position at the closure top.

The second lid 40, which is hinged to the rear portion of top 6 by integral hinge 41 includes a planar lid body 42, a depending collar 46, and tongue 44 radially projecting from the front portion of the planar lid body. Hinge 41 is a thin strip of polymeric material to readily permit the reciprocation of the second lid 40, independently of the action of the first lid 24. The depending collar 46 projects substantially orthogonally downward from the lid 40 such that it will extend into and against the bulk access aperture when the lid 40 is in closed position. The depending collar 46 is positioned inwardly of the peripheral edge of the lid body such that an annular edge extends radially beyond the bulk access aperture when the second lid is closed over the aperture. Each of the collar 46 and the interior surface of the bulk access opening are beveled to provide for a generally functional seal upon compressive closure of the collar 46 into the bulk access opening. The collar 46 is maintained in compressive relationship against the bulk access opening periphery upon closure of the lid 40.

At each side of the outer surface of depending collar 46, substantially opposite hinges 28 and 26, projections 50 project substantially orthogonally from the depending collar to frictionally co-act in a tongue-in-groove manner with the side wall 51 of the bulk access aperture, in a manner similar to the closure fitment of the first lid 24. When the second lid 40 is in closed position, the tongue 44 radially extending from the planar lid body overlies a recess 53 in the planar top support 14 which slopes downwardly below the plane of the planar top support as the recess 53 extends radially inward toward the bulk access aperture. The recess 53 assists a user in lifting the second lid 40 from the closed position over the bulk access aperture. To open the central lid 40, upward pressure with a spoon tip may be applied to the tongue 44. Such action will break the tamper proof bridges or indicators 54, 55, 56, 57 and distort the lid 40 by elongating it along the axis of hinge movement, while compressing its diameter in a transverse direction, such that the tongue-in-groove fitment is readily released.

The illustrated embodiment is shown in initially unopened condition as may be packaged and shipped to a grocery store. At each side of the tongue 44, integrally molded, thin tamper proof bridging elements 54, 55, 56, 57 join the front portion of the second lid 40 to the rear portion of the annular lid 24, and join the rear portion of the second lid 40 to the adjacent portion of top 6 about bulk access opening. These tamper proof bridges provide indication (e.g., to a buyer or user) of whether either the first lid 24 or second lid 40 for bulk access for the container interior, or the annular lid has been opened. Because they are relatively small and thin, the seal projections 54, 55, 56, 57 will be broken when either the second lid 24 or perimeter lid 40 is first opened about their respective hinges, and hence, indicate whether either lid has been opened. As shown in FIG. 2, the bridges 54, 55, 56, 57 produce projecting stubs from their respective point of attachment upon opening, which do not interfere with reclosure or subsequent opening of either lid 40, 24.

FIGS. 6 and 7 illustrate the closure in its unassembled form prior to folding assembly and sealing on the container. FIG. 6 illustrates the bottom surface of top 6 and the top surface of base 12. FIG. 7 illustrates the top surface of top 6 and the bottom surface of base 12. The illustrated lid 4 is manufactured in opened form as shown in FIGS. 6 and 7 by an injection molding process using an appropriate, conforming mold, although other techniques, such as compression molding might well be used. In the embodiment 4, viewing FIG. 6 as a mold for purposes of description, polypropylene having a relatively high melt index of about 30 is injected into the mold at a point 59 along the axis of bilateral symmetry of the closure 4. The molten polypropylene flows to form the section 12, and flows through the narrowed volume defined by hinge 16 into the volume defined by section 6, where the molten plastic must again pass through respective hinge areas 26, 28, 41 of the first and second lids 24, 50. The provision of a high melt index polypropylene resin facilitates the manufacture of the closure 4 having the above described molding flow pattern.

After cooling and removal from the mold, the closure 4 is in unassembled form as shown in FIGS. 6 and 7. The closure is then folded at hinge 16, with elements 6 and 12 in register, and anchor posts 80, 82 are pressed through respective anchor holes 81, 83 which are provided in symmetrical register therewith.

In this regard, as shown in FIG. 6, the bottom surface of top element 6 has cylindrical anchor posts 80 and 82 adapted to project into anchor holes 81 and 83, to anchor the top 6 to the base 12 when the closure is seated on an associated container. The external surfaces of anchor posts 80 and 82 have anchor projections 84 and 86 respectively which are thin annular projections about midway the length of the anchor posts and which abut the lower surface of base 12, as seen in FIG. 5, to hold the top 6 over the base 12 when the closure is assembled and seated on an associated container. Anchor holes 81 and 83 are provided with a diameter sufficiently less than the diameter of the anchor posts at their respective anchor projections, that upon forcefully projecting the anchor posts through the anchor holes, the top 6 and base 12 are maintained in folded condition. It is not intended that the posts 80, 82 be subsequently removed from the anchor holes 81, 83.

As shown in FIG. 7, the bottom surface of base 12 has front brace 66 between holes 20 and 22, rear braces 68 and 70, and reinforcing side braces 72, 73, 74, 75, 76 and 78. Each of these braces have a generally triangular shape, extending from the peripheral rim to a circular reinforcing projection 77 generally adjacent and concentric with the bulk access aperture. The concentric reinforcing projection 77 is, however, spaced from the opening so as not to interfere with the closure function of the lid associated therewith. As indicated, braces 68, 70, 72, 73, 74, 75, 76 and 78 angularly descend from the bottom surface of the planar surface of top 6 along the interior surface of depending skirt of base 12, and function to provide structural rigidity to the lid and the bulk access opening therein to provide for proper opening and closure operation thereof. The reinforcing braces are each terminated in the reinforcing ridge 77 located adjacent to the edge of the circular bulk access opening, so that they do not interfere with the maintenance of a smooth circular shape of the opening, upon cooling of the organopolymeric material during manufacture thereof. In this manner, a fit between the lid and the bulk access opening is maintained upon cooling of the lid from the injection molding process without preferential shrinking at the points of intersection with the rib structure.

The groove 53 in the top surface of base 12 creates a depending projection 88 from the bottom surface of base 12 between holes 20 and 22. Depending projection 88 angularly descends from the bottom surface of the base as the groove and resulting projection radially extends toward the center of the closure. Front brace 66 angularly descends from the bottom surface of depending projection 88 down the interior surface of depending skirt of the base 12. Each of the braces give the entire closure structural stability for repeated opening and closing of the annular lid and second lid.

Figure 1:
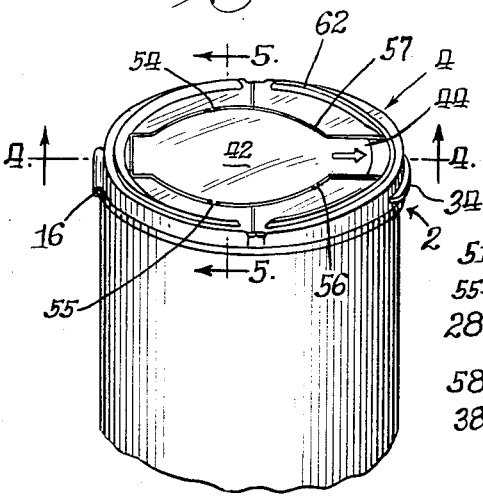
FIG. 1 is a perspective view of the closure and container in a closed position.

As is most clearly seen in FIG. 7 and FIG. 1, the top surface of top 6 has an annular structural support rib 62 projecting from the top surface radially set inwardly from the periphery of the top surface of top 6. The structural support rib annularly extends around the rear portion 23 of the top to the hinges 26 and 28. The structural support rib extends around the annular lid in sections 65 and 67 which are to each side of notch 36 and extend from hinges 26 and 28 to the notch 36.

FIG. 8 illustrates how the closure is assembled for use on an associated container 2. As indicated, the top 6 is folded about hinge 16 such that cylindrical anchor posts 80 and 82 are engaged in into anchor holes 81 and 83. The anchor projections 84 and 86 on the anchor posts are snapped below the top surface of base 12 and render the rear portion 23 off top 6 substantially permanently affixed to base 12 for the use of the closure with the associated container. Posts 30 and 32 of the annular lid also are thrust into holes 20 and 22, but may be withdrawn therefrom with use of the annular means for access. In the illustrated embodiment, the closed, assembled closure 4 may be affixed to a cylindrical container 2 having a height of 5.562 inches and an internal diameter of 2.802 inches by means of a suitable hot melt or cold adhesive.

While the present invention has been shown and described with respect to a specific preferred embodiment thereof, it should be apparent that various modifications, adaptations and variations may be made utilizing the teachings of the present disclosure without departing from the scope of the invention, and are intended to be within the scope of the following claims.

Various features of the invention are set forth in the following claims.

What is claimed is:

1. A rigid one piece multiaction organopolymeric closure for a container for particulate materials such as grated cheese or the like which may be readily opened and closed, which provides a substantially airtight seal, and which selectively permits bulk or broadcast removal of the particulate product from the container comprising, a substantially planar two layer composite top panel and a substantially cylindrical skirt projecting from said top panel for engagement with the proximate rim of an associated cylindrical container, said two layer composite top panel comprising a circular base panel and an overlying lid panel integrally joined together at a portion of their respective circumferential edges by means of an assembly hinge element, said base panel having a centrally located bulk access aperture for bulk removal of particulate material from said container, a plurality of assembly holes at the side of said base panel proximal to said assembly hinge element;

said base panel having a plurality of broadcast holes radially outside said aperature at the side of said base panel distally of said hinge elements for the broadcast of particulate material from said container;

said overlying lid panel comprising a generally crescent-shaped fixed position annular hinge base segment, a generally crescent-shaped broadcast lid closure segment, and a bulk aperture closure segment joined to said fixed position hinge base segement by a bulk access hinge element, said overlying lid panel segment having a plurality of posts which project through said assembly holes of said base panel in interlocking engagement to maintain said annular hinge base segment in fixed position adjacent said base panel, said fixed position annular hinge base segment being integrally joined to said broadcast lid closure segment by two crescent hinge elements respectively joining their respective crescent ends, said broadcast lid closure segment having tongue-in-groove fitment with said plurality of broadcast holes in said base panel for placement over said holes, and bulk aperture closure segment having tongue-in-groove fitment with said bulk access aperture of said base radially inwardly of said annularly surrounding fixed position hinge base segment and broadcast lid closure segment for placement over said aperture.

2. A closure in accordance with claim 1 wherein said bulk aperture closure segment has a tongue radially extending therefrom for gripping and opening said bulk aperture closure segment, and a depending collar descending therefrom; and said bulk access aperture closure segment has side walls which frictionally engage said depending collar when said bulk aperture closure segment overlies said aperture to maintain said bulk aperture closure segment in a closed position.

3. A closure in accordance with claim 2 wherein said broadcast lid closure segment has a notch, said tongue of said bulk aperture closure segment extending into said notch to facilitate the grasping of said tongue and the opening of said lid.

4. A closure in accordance with claim 1 wherein said closure is formed of polypropylene having a flexural modulus of at least about 170,000 psi.

5. A closure in accordance with claim 1 having a plurality of supporting braces descending from said base panel and joining with said skirt, and wherein a reinforcing projection is provided concentric with and projecting from said bulk access aperture, said supporting braces being spaced from said bulk access aperture.

6. A closure in accordance with claim 1 wherein said bulk access closure segment is joined to said broadcast closure segment by thin tamper indicating elements which may be readily broken upon the initial opening of either said broadcast lid closure segment or said bulk aperture closure segment.

* * * * *